US006021724A

United States Patent [19]

Dahl et al.

[11] Patent Number: 6,021,724

[45] Date of Patent: Feb. 8, 2000

[54] CYCLONE FURNACE FOR RETROFIT APPLICATIONS

[75] Inventors: Manvil O. Dahl, Lake Township, Stark County; Hamid Farzan, Jackson Township, Stark County; John E. Granger, Bath Township, Summit County; Gerald J. Maringo, Canton, all of Ohio

[73] Assignees: The Babcock & Wilcox Company; McDermott Technology, Inc., both of New Orleans, La.

[21] Appl. No.: 08/966,110

[22] Filed: Nov. 7, 1997

[51] Int. Cl.[7] ..... F23D 1/02; F22B 37/00

[52] U.S. Cl. ..... 110/264; 110/266; 110/261; 110/322; 110/336; 122/6 A; 122/20 B; 122/235.24

[58] Field of Search ..... 110/203, 210, 110/211, 212, 213, 214, 216, 260, 261, 262, 263, 264, 265, 266, 322, 336, 337; 122/6 A, 20 B, 235.15, 235.24, 488, 489; 431/9

[56] References Cited

U.S. PATENT DOCUMENTS

| | | | |
|---|---|---|---|
| 2,594,312 | 4/1952 | Kerr et al. | 110/264 X |
| 2,731,955 | 1/1956 | Lenhart et al. | 110/264 X |
| 2,858,780 | 11/1958 | Sifrin et al. | 110/322 X |
| 2,881,720 | 4/1959 | Lotz | 110/266 |
| 2,891,493 | 6/1959 | Gram, Jr. et al. | 110/266 |
| 2,899,917 | 8/1959 | Lichtenberger | 110/266 |
| 2,971,480 | 2/1961 | Sage | 110/265 |
| 5,549,059 | 8/1996 | Nechvatal et al. | 110/346 |

FOREIGN PATENT DOCUMENTS

| | | | |
|---|---|---|---|
| 763873 | 12/1956 | United Kingdom | 110/266 |

OTHER PUBLICATIONS

*Steam: its generation and use*, 40th Edition, The Babcock & Wilcox Company ©1992. pp. 14–1 to 14–11.

*Steam/its generation and use*, 40th Edition, The Babcock & Wilcox Company ©1992, pp. 25–8 and 25–9 and 31–8 and 31–9.

*Steam/ its generation and use*, 39th Edition, The Babcock & Wilcox Company ©1978, pp. 25–5 thru 25–10 and page 27–10.

*Primary Examiner*—Ira S. Lazarus
*Assistant Examiner*—Ljiljana V. Ciric
*Attorney, Agent, or Firm*—R. J. Edwards; Eric Marich

[57] ABSTRACT

An improved Cyclone furnace particularly suitable for retrofit applications to an existing boiler incorporates a Cyclone furnace and an integrated de-slagging chamber as a single manufactured piece. The Cyclone furnace and the de-slagging chamber are provided with a water cooling circuit which is separate from a water cooling circuit of the existing boiler to which it may be coupled, permitting the improved Cyclone furnace to be easily retrofitted to existing boilers or furnaces, even those not originally designed for Cyclone firing.

10 Claims, 4 Drawing Sheets

FROM
103 110 116,118 119
PUMP MEANS
140
TO
103
110
116,118
119
Primary air injection location
122
Coal chute chrushed coal 1/4" screen mesh
123
Coal burner
108
124
Tertiary air inlet means
102
130
Secondary air injection location
128
Secondary air inlet
126
106
Fuel and/or Sludge nozzles
110
Cyclone barrel
100
103
105
Slag spout opening
119
114
104
112
Slag tap
121
130
114
120
118
Target wall
150
Screen tubes
116
To main furnace or boiler
160

CYCLONE FURNACE FOR RETROFIT APPLICATIONS

FIELD OF THE INVENTION

The present invention relates generally to Cyclone furnaces for combusting fuels and, in particular, to an improved Cyclone furnace apparatus which can be easily retrofit to existing boiler applications, even if they were not originally designed to use a Cyclone furnace. The present invention accomplishes this result by incorporating and integrating together a de-slagging chamber together with a Cyclone furnace as a single manufactured piece. The de-slagging chamber removes the majority of the flyash from the combustion gases and permits relatively clean flue gas to be introduced into a main boiler or furnace, to which it can be attached.

BACKGROUND OF THE INVENTION

Cyclone furnaces were developed by The Babcock & Wilcox Company (B&W) in the USA in the 1940's. These Cyclones had the ability to burn high-ash low-fusion temperature coals, which are particularly troublesome in pulverized coal boilers. For a general description of the characteristics of such Cyclone furnaces, the reader is referred to Chapter 14 of *Steam/its Generation and Use*, 40th Edition, The Babcock & Wilcox Company, Barberton, Ohio, U.S.A., ©1992, the text of which is hereby incorporated by reference as though fully set forth herein.

The Cyclone furnace (as schematically shown in FIG. 1) consists of a Cyclone burner connected to a horizontal water-cooled cylinder, the Cyclone barrel. The water circuitry between the Cyclone furnace and the boiler is extremely complex and does not lend itself to being an easily retrofit-type system. Air and crushed coal are introduced through the Cyclone burner into the Cyclone barrel. The larger coal particles are thrust out to the barrel walls by the cyclonic motion of combustion air where they are captured and burned in the molten slag layer that is formed; the finer particles burn in suspension. The mineral matter melts and exits the Cyclone via a tap at the Cyclone throat that leads to a water-filled slag tank (not shown). The combustion gases and remaining ash leave the Cyclone and enter the main furnace.

B&W later helped in the development of the "Secant Firing" technique. This was mainly developed to burn poorer quality German bituminous coals. These coals have lower volatile matter/higher moisture contents which results in associated combustion problems and produced lower Cyclone operating temperatures. To address these operational concerns, B&W helped develop both tangential and secant firing techniques as shown in FIGS. 2 and 3. Finely ground coal is introduced adjacent to the secondary air (tangential firing) or is injected through a series of ports located below the secondary air inlet (secant firing). Based on improved overall Cyclone operational experience, secant firing was chosen as the preferred method.

The Cyclone furnace utilizes centrifugal forces to suspend burning fuel particles, according to their size, in equilibrium against the drag of inwardly directed air flow. The Cyclone furnace has been used with various boiler types: Stirling (SPB), Radiant Boiler (RB) and Universal Pressure (UP) boilers. Due to the centrifugal force created from the Cyclone reentrant throat, the combustion gas flow patterns have been less uniform than that achieved in pulverized coal fired boilers. In one design B&W uses a target wall and/or a screen tube arrangement to straighten the gas flow patterns.

FIGS. 4 and 5 illustrate schematically such a Cyclone furnace/screen tube arrangement. These screen tubes were built inside the main boiler and they were a part of the main boiler water circuit. This design of the Cyclone increases the slag and reduces the fly ash entering the main boiler.

When a fuel is burned in a Cyclone boiler the ash content in the fuel is converted to molten slag or it is entrained in the gas as fly ash. It is desirable to reduce the fly ash and increase slag which can be used as construction material, etc. In addition, firing high ash fuels enhances the following concerns: furnace wall slagging, convection pass fouling, and flyash disposal. These negative consequences dictate a need for a lower flyash loading to the main boiler. Slag screen tube arrangements inside the boiler (FIGS. 4 and 5) have been used to help straighten the flue gas flow as well as to improve the ash capture. Although screen tubes are a viable approach in new boiler applications, they cannot be simply applied as a retrofit option. This is due to the complexity of the existing water circuitry between the Cyclone furnace and boiler. Any such retrofit requires a new methodology to incorporate the new Cyclone into the system.

In addition, a solid fuel firing Cyclone furnace cannot be attached to a boiler designed to burn gas and oil. These boilers are not designed for carrying high ash/slag content combustion gases. If a Cyclone furnace alone is added to a boiler, some of the slag/flyash from the Cyclone will enter the main boiler and will be deposited on the heat transfer surfaces. As a result, the boiler heat absorption profiles, steam production, and general boiler operation will be negatively impacted.

SUMMARY OF THE INVENTION

The present invention is drawn to a relatively trouble free Cyclone furnace apparatus which can be retrofitted to an existing boiler or furnace system, even one not originally designed for a Cyclone furnace, which reduces the flyash/slag content in the flue gas prior to its entrance into a main boiler region.

Accordingly, one aspect of the present invention is drawn to an integrated Cyclone furnace and de-slagging chamber apparatus. The apparatus comprises, in combination, a Cyclone furnace and a de-slagging chamber to achieve a unique and easily retrofit combustion apparatus suitable for use with many types of boiler apparatus. More particularly, the combination comprises a Cyclone furnace having a Cyclone barrel, a re-entrant throat, a slag spout opening, and means for introducing fuel and combustion air into the Cyclone furnace, for combusting said fuel to produce combustion flue gases containing flyash and molten slag. In addition, there is provided a de-slagging chamber having a plurality of walls including a front wall, a rear wall including a target wall and an array of screen tubes, and a slag tap. The de-slagging chamber is integrated structurally and fluidically with the Cyclone furnace so that both share a common fluid-cooling system which fluidically interconnects the Cyclone furnace and the walls of the de-slagging chamber. The front wall of the de-slagging chamber is connected to the Cyclone furnace so as to receive therethrough the combustion gases containing flyash and the molten slag, while the array of screen tubes and the target wall are operative to collect flyash and molten slag from the combustion gases as they pass through the array of screen tubes and exit from the de-slagging chamber.

The various features of novelty which characterize the invention are pointed out with particularity in the claims annexed to and forming a part of this disclosure. For a better understanding of the invention, its operating advantages and the specific benefits attained by its uses, reference is made to the accompanying drawings and descriptive matter in which preferred embodiments of the invention are illustrated.

DESCRIPTION OF THE PREFERRED EMBODIMENTS

Figure 1:
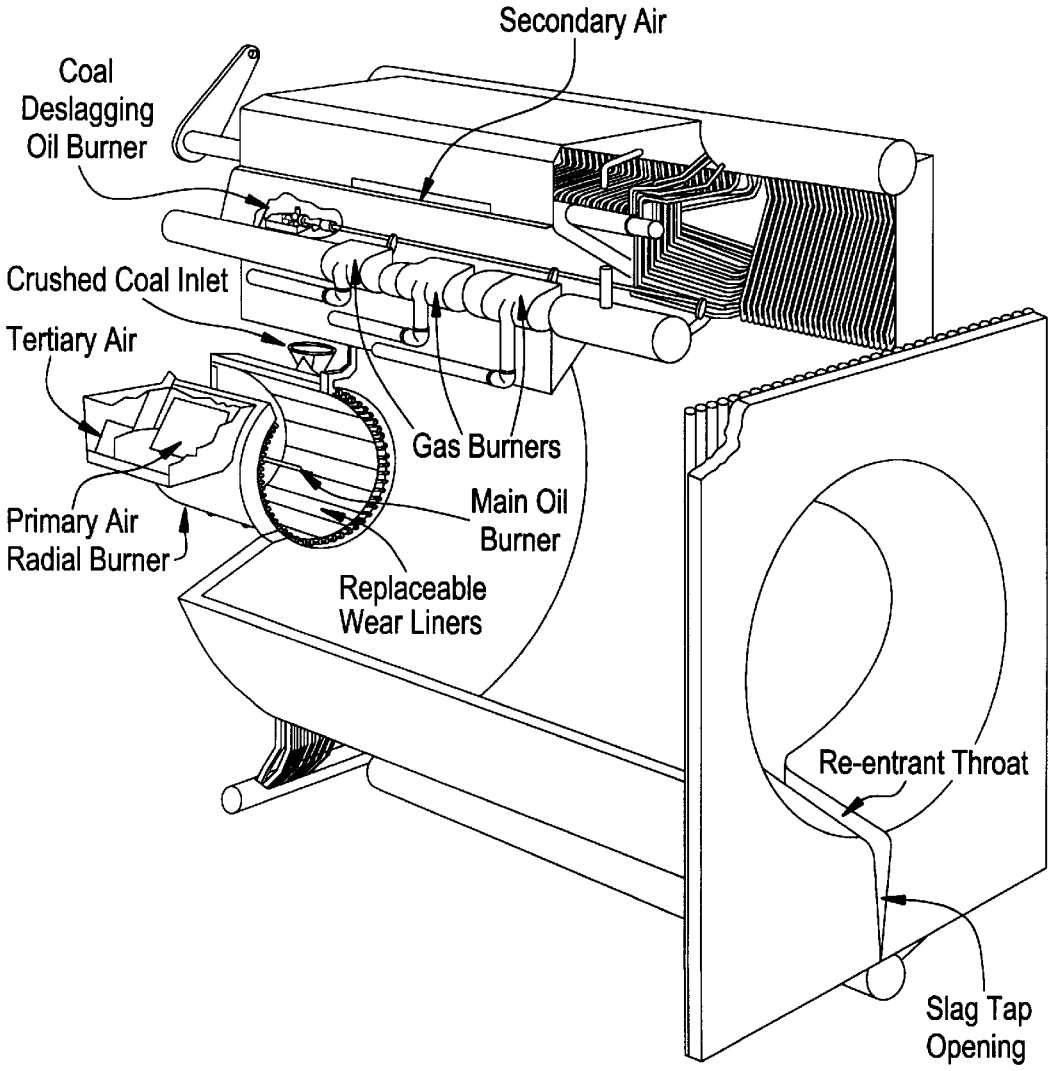
FIG. 1 PRIOR ART
FIG. 1 is a perspective view, partially in section, of a known Cyclone furnace design.
Figure 2:
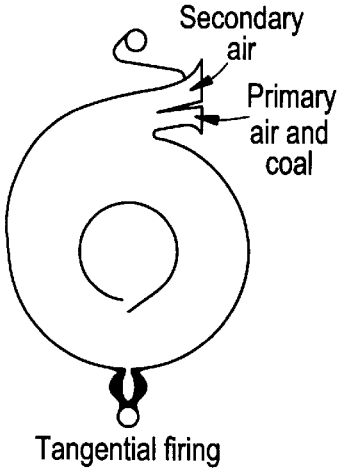
FIG. 2 PRIOR ART
FIGS. 2 & 3 are schematic end views of known tangential and secant Cyclone furnace fuel delivery approaches.
Figure 3:
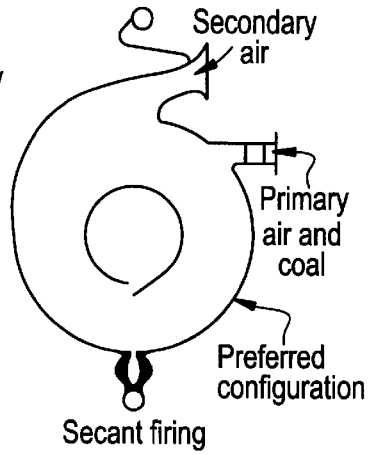
FIG. 3 PRIOR ART
Figure 4:
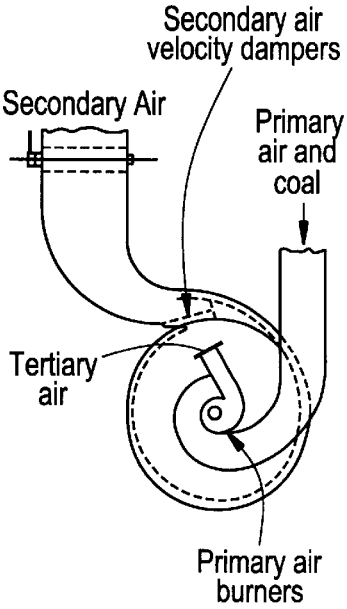
FIG. 4 PRIOR ART
FIGS. 4 & 5 are schematic end and sectional views, respectively, of a Cyclone furnace target wall and/or screen tube arrangement incorporated as part of and built inside a main boiler furnace.
Figure 5:
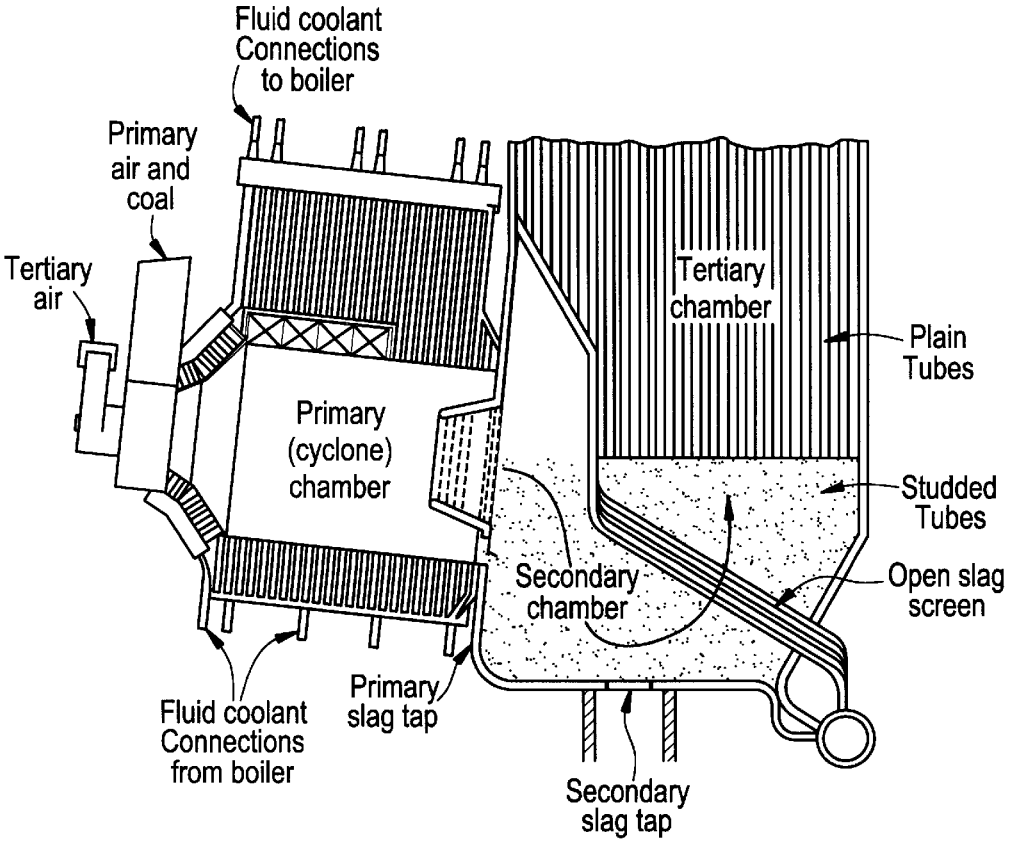
FIG. 5 PRIOR ART

Referring to the drawings generally, wherein like reference numerals designate the same or functionally similar elements throughout the several drawings, and to FIG. 6 in particular, an integrated Cyclone furnace and de-slagging chamber, generally designated 100 and hereinafter referred to as integrated CFDC 100, is shown. The integrated CFDC is comprised of two main parts, a Cyclone furnace 102 and a de-slagging chamber 104. The Cyclone furnace 102 is connected to the de-slagging chamber 104 as a single manufactured piece. The primary fuel for combustion enters the Cyclone furnace 102 through secant ports 106, or through a Cyclone burner 108, advantageously a coal burner 108, or via atomizers, or other specially designed fuel elements located in the center of the Cyclone furnace 102. The particular design depends on the type of fuel or waste product to be burned. The majority of the fuel burns in the barrel 110 of the Cyclone furnace 102 and the combustion gases 112 and molten flyash 114 exits the Cyclone furnace 102 via a re-entrant throat 103 and enters the de-slagging chamber 104. Molten slag 114 produced in the Cyclone furnace 102 exits therefrom through a slag spout opening 105 and pours into the bottom of the de-slagging chamber 104. The de-slagging chamber 104 is water-cooled and coated with refractory and removes the majority of the molten flyash 114 from combustion gases 112. The relatively clean flue gas 112 then leaves the de-slagging chamber 104 and is introduced into the main furnace or boiler (not shown).

The integrated CFDC design 100 is unique since a slag screen or array of screen tubes 116, and a target wall 118 have been incorporated into the de-slagging chamber 104 and integrated with the Cyclone furnace 102 as a singular unit which lends itself to being easily retrofitted to a variety of boiler types. Since the integrated CFDC 100 removes the majority of the ash 114 from the combustion gases 112 before entering the main boiler, the new "packaged" CFDC 100 can be used to retrofit gas and oil firing boilers to solid fuel firing without adversely affecting the boiler steam flow/operation. In addition, retrofitting this concept to existing coal (solid fuel) fired boilers would enhance the operation of these units since substantially less operation and maintenance problems would be experienced due to lower boiler flyash levels. This would also minimize back-end clean-up equipment. Similarly, the integrated CFDC 100 can also be adapted/mated to known package boiler designs.

Package boilers, per se, are known from The Babcock & Wilcox Company publication *Steam/its generation and use*, 40th Edition, at page 25–8. A particularly successful package boiler design is known as the FM Package Boiler manufactured by The Babcock & Wilcox Company and disclosed in the publication *Steam/its generation and use*, 40th Edition, at page 25–8. Other types of package boilers include what are known as "F" type boilers, particularly the PFI (Power for Industry) and PFT (Power for Turbine) types described in *Steam/its Generation and use*, 39th Edition, at pages 25–8 and 25–9. Also known are the "Three Drum Waste Heat Boilers" shown on page 27–10, FIG. 10, of *Steam/its generation and use*, 39th Edition, and on page 31–8 of *Steam/its generation and use*, 40th Edition. This latter type of boiler is also known as an "FO" type, and in the industry as simply an "O" type boiler.

It is thus understood that the present invention is not limited to any particular type of package boiler. Possible applications readily known to those skilled in the art would include any of the aforementioned FM or "F" type boilers including the PFI and PFT types, as well as the commonly known as the "FO" or "O" type. boilers. All such configurations are readily usable in combination with the present invention.

The complete unit 100 (integrated Cyclone and de-slagging chamber 104) utilizes a common water cooling circuit which is separate from that employed in the main boiler system. This feature enables a practical means to retrofit the integrated CFDC 100 to an existing unit. The outlet of the de-slagging chamber 104 of the integrated CFDC 100 could be attached to the main boiler 160 via a flue system 150 to allow the combustion gases 112 to flow to the main boiler 160. Without this invention, the slag screen arrangement or array of screen tubes 116 would have to be located inside the main boiler 160 and must be cooled. Although this task would not be impossible, it would be very expensive. Also, the task of connecting just a Cyclone furnace and a boiler would be more difficult since molten flyash would still exist within the gas stream leaving the Cyclone furnace. The present invention eliminates these problems, since the entire integrated CFDC 100 would be self contained outside the boiler and provided with its own separate cooling circuitry.

The de-slagging chamber 104 preferably has a plurality of water-cooled walls including a front wall 119, a rear wall 120 including the target wall 118 and the array of screen tubes 116, and a slag tap 121. The de-slagging chamber 104 is integrated structurally and fluidically with the Cyclone furnace 102 so that both share a common fluid-cooling system which fluidically interconnects the Cyclone furnace 102 and the fluidically-cooled walls of the de-slagging chamber 104. The front wall 119 of the de-slagging chamber 104 is connected to the re-entrant throat 103 of the Cyclone furnace 102 so as to receive therethrough the combustion gases 112 containing the flyash and the molten slag 114. The array of screen tubes 116 and the target wall 118 operate to collect most of the flyash and molten slag 114 from the combustion gases 112 as they pass through the array of screen tubes 116 and exit from the de-slagging chamber 104.

Figure 8:
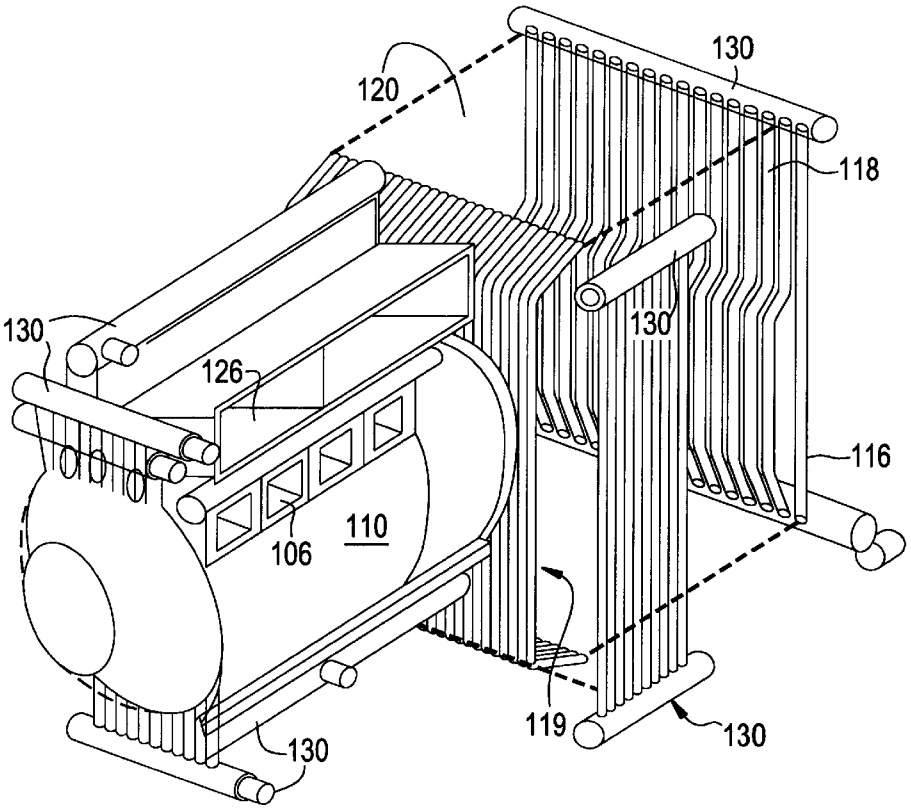
FIG. 8 is a schematic outside perspective view, partially in section, of the embodiment of FIG. 7.

As is known to those skilled in the art, the Cyclone furnace is also typically comprised of fluid-cooled tubes. While both the array of screen tubes 116 and the target wall 118 are comprised of fluid-cooled tubes, their positions relative to one another may be varied, depending upon the needs of a particular installation. In a first embodiment, illustrated in FIG. 6, the array of screen tubes 116 is preferably located above the fluid-cooled tubes forming the target wall 118 of the rear wall 120 of the de-slagging chamber 104. However, this arrangement may be inverted, and as illustrated in FIGS. 7 and 8, the array of screen tubes 116 may be located below the fluid-cooled tubes forming the target wall 118. Advantageously, all of the tubes forming the plurality of walls of the de-slagging chamber 104 are tangent to one another and membraned to provide a gas-tight enclosure.

Of course, since the integrated CFDC 100 is a combustion apparatus, means are provided for introducing fuel into the Cyclone furnace 102, and advantageously comprise one or more secant fuel nozzles 106 arranged along a wall of the Cyclone barrel 110. The fuel introduction means also comprises burner means 108 located at an end of the Cyclone barrel 110 opposite the re-entrant throat 103, preferably a coal burner 108 including primary air injection means 123 for injecting primary air 122, as well as tertiary air injection means 104.

Since not all of the air for combustion is provided as primary or tertiary air, additional combustion air must be provided to the Cyclone furnace 102. For this purpose, secondary air inlet means 126 are provided for introducing secondary air 128 along at least a portion of the length of the Cyclone barrel 110.

While the walls of the de-slagging chamber 104 are comprised of panels of membrane wall tubes, headers 130 must be provided and connected to the tubes forming these panels to introduce and extract the circulating cooling fluid through these tubes. These aspects are illustrated in FIGS. 6, 7, and 8.

Figure 6:
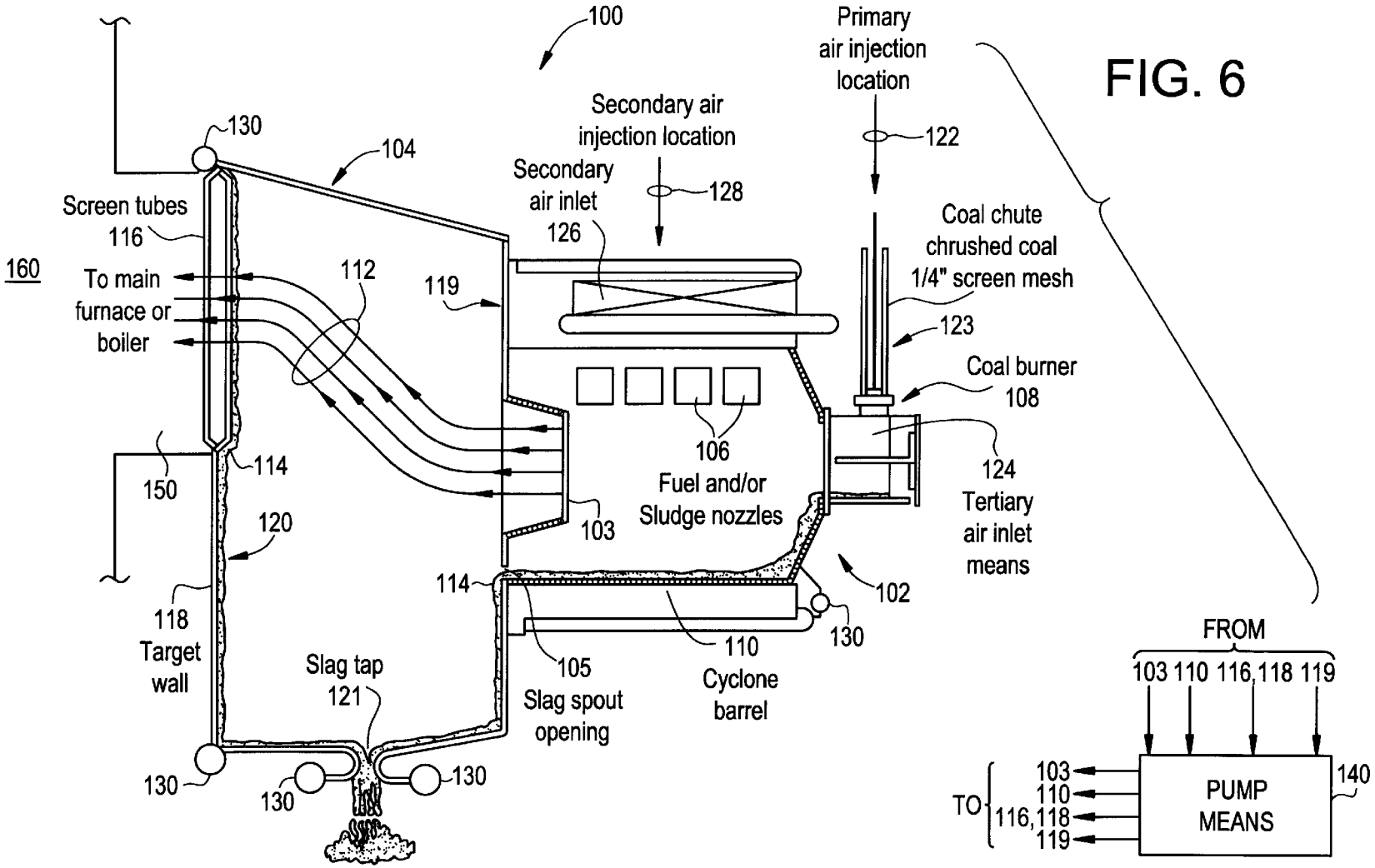
FIG. 6 is a schematic sectional side view of a first embodiment of the integrated Cyclone furnace and de-slagging chamber apparatus according to the present invention.
Figure 7:
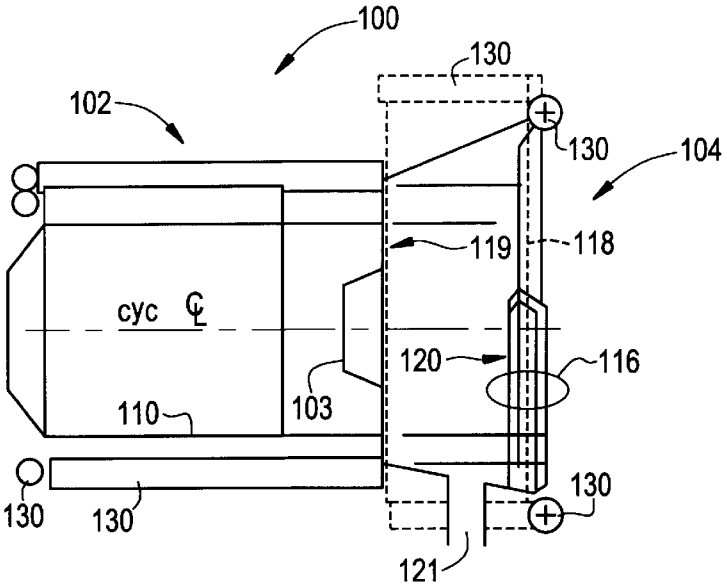
FIG. 7 is a schematic sectional side view of a second embodiment of the integrated Cyclone furnace and de-slagging chamber apparatus according to the present invention.

Finally, to circulate the cooling fluid through the walls of the de-slagging chamber 104 and the Cyclone furnace 102, pump means schematically indicated at 140 in FIG. 6, are provided. Pump means circulates the cooling fluid through the common fluid-cooling system which fluidically interconnects the Cyclone furnace 102 and the walls of the de-slagging chamber 104. The pump means 140 may feed any of the components comprising the integrated CFDC 100 in series or combination arrangements; the particular form will be dictated by heat transfer and fluid pressure drop considerations. Thus while several arrows schematically indicate the various subcomponents which may be supplied by pump means 140, it is understood that various combinations may be employed and the illustrative description of FIG. 6 is for the purpose of description and not limitation.

The ability of the integrated CFDC 100 system to melt and then capture the mineral matter into a removable/saleable slag is an important function of this invention. It reduces flyash to the convection pass and consequently, minimizes back-end clean-up system requirements.

More importantly, the integrated CFDC 100 provides an easy retrofitted system with high slagging and low fly ash operational characteristics. Currently, there is not a self contained combustion modification technology which can accomplish these tasks. Low temperature systems such as fluidized bed combustion can be utilized to burn sludge and high ash fuels, but the both have the disadvantage that the solid waste has to then be treated as a landfill material and this is a costly alternative.

While specific embodiments of the invention have been shown and described in detail to illustrate the application of the principles of the invention, those skilled in the art will appreciate that changes may be made in the form of the invention covered by the following claims without departing from such principles. For example, the present invention may be applied to new construction involving Cyclone furnaces, or to the replacement, repair or modification of existing boilers, whether or not they were originally designed for Cyclone service. This would include any of the aforementioned factory assembled, field-ready, package type boilers or combustors as well as pre-existing PC fired or oil/gas fired units. In some embodiments of the invention, certain features of the invention may sometimes be used to advantage without a corresponding use of the other features. Accordingly, all such changes and embodiments properly fall within the scope of the following claims.

We claim:

1. An integrated Cyclone furnace and de-slagging chamber apparatus which can be retrofitted to an existing boiler as a single manufactured piece, comprising in combination:

a Cyclone furnace having a Cyclone barrel, a re-entrant throat, a slag spout opening, and means for introducing fuel and combustion air into the Cyclone furnace, for combusting said fuel to produce combustion flue gases containing flyash and molten slag; and a de-slagging chamber having a plurality of walls including a fluid-cooled front wall, a rear wall including a fluid-cooled target wall and an array of fluid-cooled screen tubes, and a slag tap, the de-slagging chamber integrated structurally and fluidically with the Cyclone furnace so that both share a common fluid-cooling system which is separate from that employed in the existing boiler and which fluidically interconnects the Cyclone furnace and the walls of the de-slagging chamber, the front wall of the de-slagging chamber connected to the Cyclone furnace so that the combustion flue gases containing flyash and the molten slag pass through the front wall, the array of fluid-cooled screen tubes and the fluid-cooled target wall operative to collect flyash and molten slag from the combustion flue gases as the combustion flue gases pass through the array of fluid-cooled screen tubes and exit from the de-slagging chamber.

2. The integrated Cyclone furnace and de-slagging chamber apparatus according to claim 1, wherein the Cyclone furnace and the plurality of fluid-cooled walls of the de-slagging chamber are comprised of fluid-cooled tubes.

3. The integrated Cyclone furnace and de-slagging chamber apparatus according to claim 1, wherein the fluid-cooled target wall is comprised of fluid-cooled tubes and the array of fluid-cooled screen tubes is located above the target wall.

4. The integrated Cyclone furnace and de-slagging chamber apparatus according to claim 1, wherein the fluid-cooled target wall is comprised of fluid-cooled tubes and the array of fluid-cooled screen tubes is located below the target wall.

5. The integrated Cyclone furnace and de-slagging chamber apparatus according to claim 1, wherein the means for introducing fuel into the Cyclone furnace comprises one or more secant fuel nozzles arranged along a wall of the Cyclone barrel.

6. The integrated Cyclone furnace and de-slagging chamber apparatus according to claim 5, wherein the means for introducing fuel into the Cyclone furnace further comprises a coal burner located at an end of the Cyclone barrel opposite the re-entrant throat.

7. The integrated Cyclone furnace and de-slagging chamber apparatus according to claim 6, wherein the coal burner includes means for injecting primary and tertiary combustion air.

8. The integrated Cyclone furnace and de-slagging chamber apparatus according to claim 1, wherein the means for introducing air for combustion into the Cyclone furnace comprises secondary air inlet means for introducing secondary air along at least a portion of the length of the Cyclone barrel.

9. The integrated Cyclone furnace and de-slagging chamber apparatus according to claim 1, wherein the fluid-cooled walls of the de-slagging chamber are comprised of panels of membrane wall tubes and headers connected to the tubes forming the panels.

10. The integrated Cyclone furnace and de-slagging chamber apparatus according to claim 1, further comprising pump means for circulating cooling fluid through the common fluid-cooling system which fluidically interconnects the Cyclone furnace and the walls of the de-slagging chamber.

* * * * *